United States Patent [19]

Romein

[11] Patent Number: 4,943,041

[45] Date of Patent: Jul. 24, 1990

[54] LIGHT-WEIGHT FOLDING MASSAGE TABLE

[76] Inventor: Daniel C. Romein, 16 Dickinson Ave., Toms River, N.J. 08753

[21] Appl. No.: 398,221

[22] Filed: Aug. 24, 1989

[51] Int. Cl.[5] ..... A61G 13/00

[52] U.S. Cl. ..... 269/322; 269/901; 269/328; 108/36

[58] Field of Search ..... 269/901, 322, 327, 328; 128/70–74; 108/35–36, 113, 130–132

[56] References Cited

U.S. PATENT DOCUMENTS 2,167,342 7/1939 York .

4,333,638 6/1982 Gillotti ..... 269/322

4,833,998 5/1989 Everett et al. .

*Primary Examiner*—Robert C. Watson

*Attorney, Agent, or Firm*—Ira M. Adler

[57] ABSTRACT

The invention is a light-weight folding massage table consisting of a pair of flat hingedly connected rectangular sections, preferably having a padded wooden surface with a peripheral wooden underframe. Two telescoping pairs of legs are rotatably attached to the sides of the frame by a leg-table frame joint at a short distance from the outer ends of the undersurface of each section. Each pair of legs is connected by a horizontal tube, or leg brace, as well as diagonal cables extending from the table and leg joint to the lower end of the opposite leg. A table-leg brace cable is connected from the lower end of each leg lengthwise to the side of the opposite section a short distance from the inner end of that section. An end cable is connected to the lower end of each leg and is detachable connected to the outward end of each section. Another pair of cables, the bridge cables, is connected at each end at the joint of the table and a leg, extends along the underside of the length of the table in an V-shaped manner. When the table is in the opened position, these cables pass through a pair of bridge tubes which extend angularly downward and is rotatably attached by a bolt which passes through the inner end of both sections, thus locking the two sections in place and distributing the load across the two sections. The bridge cable may be removed from the bridge tube, and the tube may be rotated and fixed to the undersurface of the table, so that when the legs are similarly folded up against the undersurface of the table, the table can either be closed or be placed flat on a floor. A cable connected from the end of each bridge tube, extends across the width of the table and is secured at its center to the inner end of its section. A soft face rest affixed to an outwardly facing U-shaped tube, covered widthwise with a fabric material to provide a supporting surface, is rotatably connected to a pair of curved tubes, which are upwardly notched at the opposite end. The notched end of the tubes detachably inserts into a corresponding pair of holes at the end of the table and is held in place by a spring and tab mechanism. A flat arm rest may be inserted between the face rest and the supporting surface.

3 Claims, 6 Drawing Sheets

LIGHT-WEIGHT FOLDING MASSAGE TABLE

BACKGROUND

The invention relates to a lightweight sturdy collapsible table used for massage which can easily be used in a open upright position or as a flat surface on a floor.

It is highly desirable for a masseuse to be able to easily transport a massage table and to be able to assemble and disassemble the table easily and quickly. The table must be lightweight and have a minimum number of parts. The application of various massage techniques places high loads and stresses on the surface of the table and its members. Prior tables relied heavily on wooden or metal bracing members, which resulted in excess weight and the need to place the supporting members a distance from the table edge resulting in excess torque and strain. By extensive use of approriately attached cables, replacing heavy structural members, as has been used in ultralight aircraft, considerable weight is reduced, without a sacrifice in load bearing capacity. Cables as braces are elastic, as opposed to solid members, and do not tear as easily when overstressed or squeak when pressure is applied. The use of cabling also permits rapid assembly and disassembly of the table. Prior tables which used cables to absorb the load resulted in a poor distribution of the load on the table with a corresponding high rate of wear and part failure. It is key, as in the present invention, for the legs to be rigidly supported or braced against lateral or longitudinal movement. It is also highly desirable, for certain massage techniques, for the table to be used flat on the floor, as is possible with this invention.

SUMMARY OF THE INVENTION

The invention provides a light-weight folding highly stable massage table which uses a cabling system capable of supporting a person being massaged, when the table is both in an upright and a flat position. together with the pressure exerted on the person by the masseuse.

DETAILED DESCRIPTION

Figure 1:
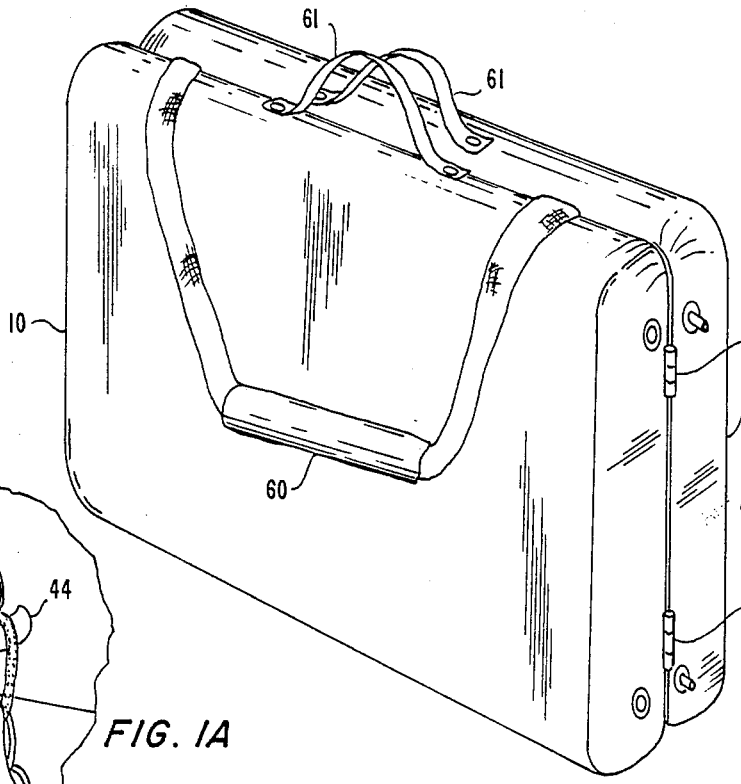
FIG. 1 is a perspective view of the massage table in a closed position.
Figure 1A:
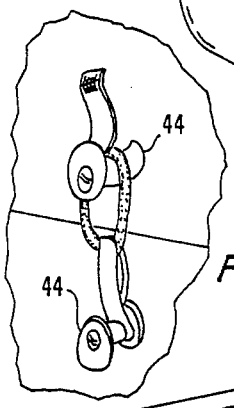
FIG. 1A is an enlarged exploded view of the table clasping mechanism.
Figure 2:
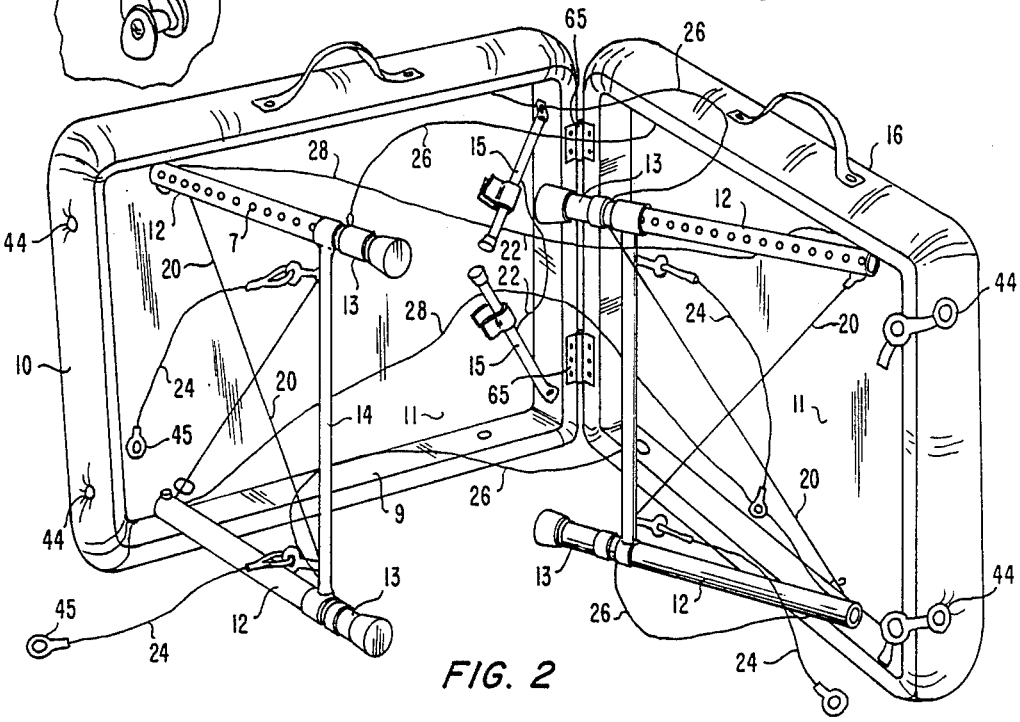
FIG. 2 is a perspective view of the underside of the table in a semi-opened position.
Figure 3:
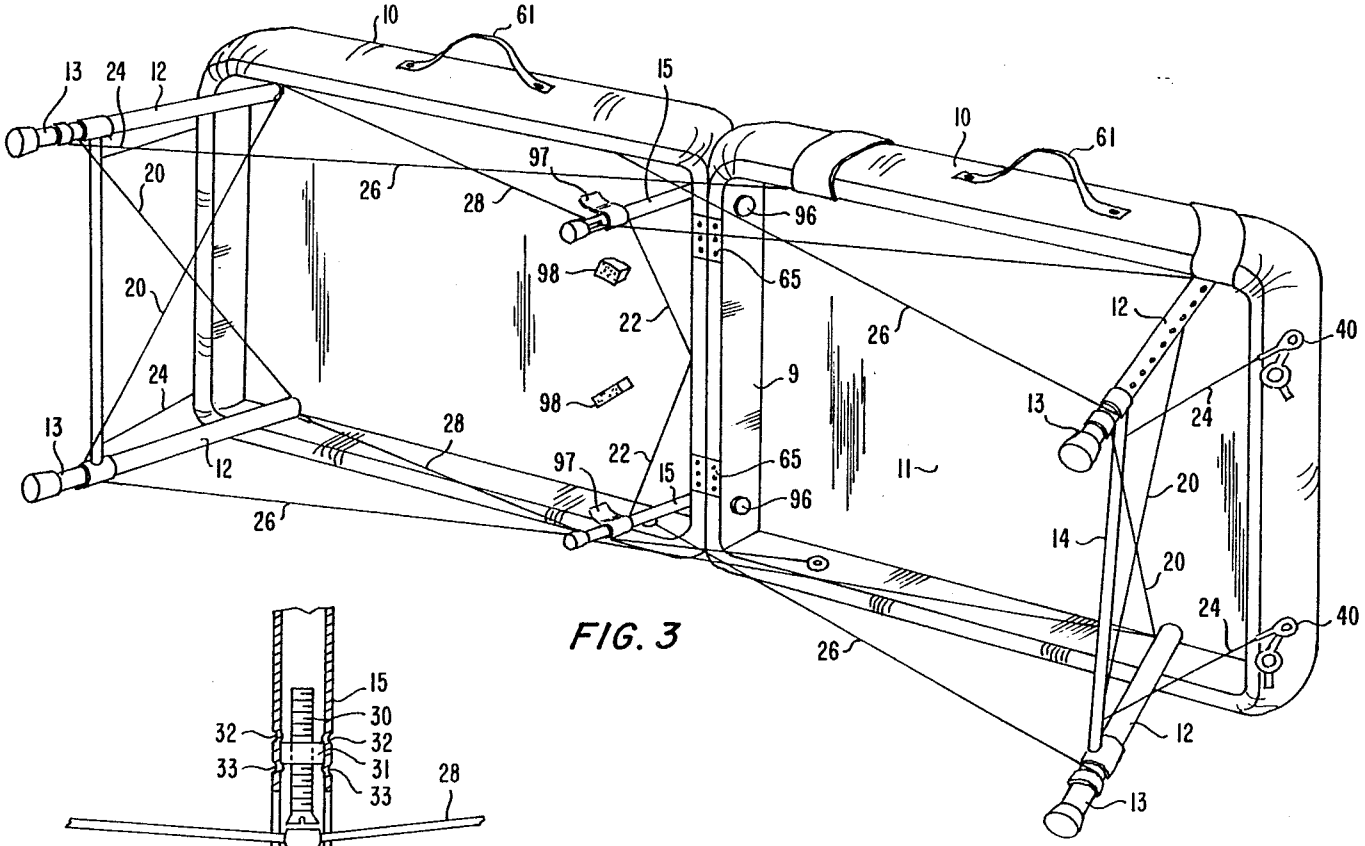
FIG. 3 is a perspective view of the underside of the table in a fully opened position.
Figure 14:
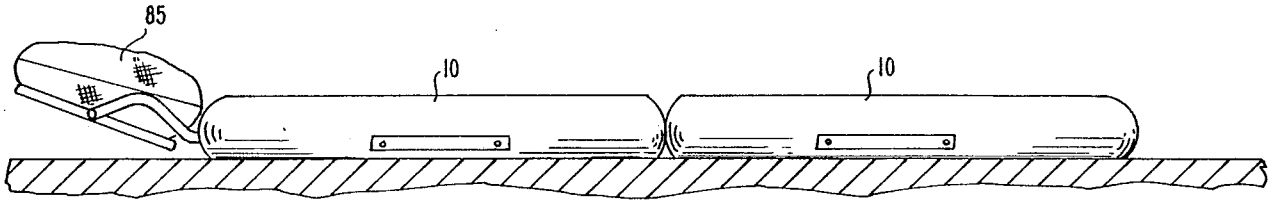
FIG. 14 is a side view of the table in the opened flat position.

The preferred embodiment of the folding table, as shown in FIG. 1 in a closed position, in FIG. 2 in a semi-opened position, in FIG. 3 in a fully opened position, and in FIG. 14 in an opened flat position, consists of pair sections of padded 10 wooden rectangualr surfaces 11 with a peripheral underframe 9. The sections are joined together by a hinged means 65.

Figure 7:
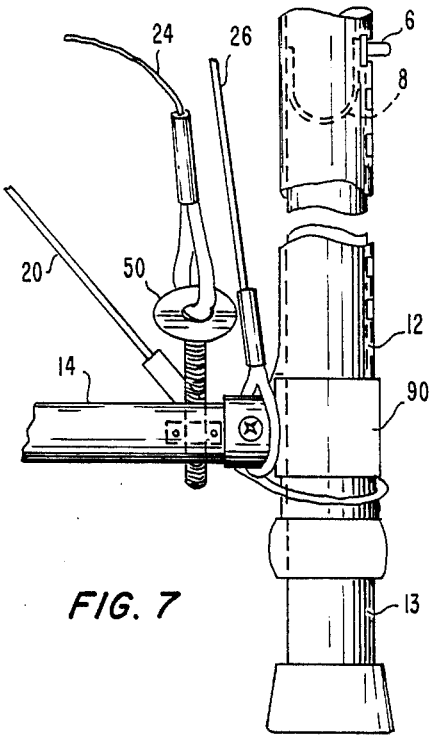
FIG. 7 is a enlarged view of a leg and leg brace joint.
Figure 9:
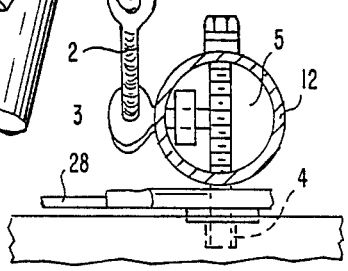
FIG. 9 is a top sectional view of a leg and leg-table frame joint.

Two telescoping pairs of legs are rotatably attached to the inner side of the table frame a short distance from the outer ends of the undersurface of each section, by means of a bolt 5 inserted into a T-nut 4, as shown in FIG. 9. The legs consist of an inner tube 13 inserted into an outer tube 12. The outer tubes contains a multiplicity of holes 7 running along its length. The inner tubes contain a U-shaped spring 8 inside, with a button-like tip 6 attached at one end, the button passing through a hole in the inner tube and a hole in the outer tube, which firmly fixes the leg at the desired length, as shown in FIG. 7. The pair of legs are connected by a horizontal brace tube 14 affixed to each leg by a T-fixture 90, as shown in FIG. 7.

Figure 8:
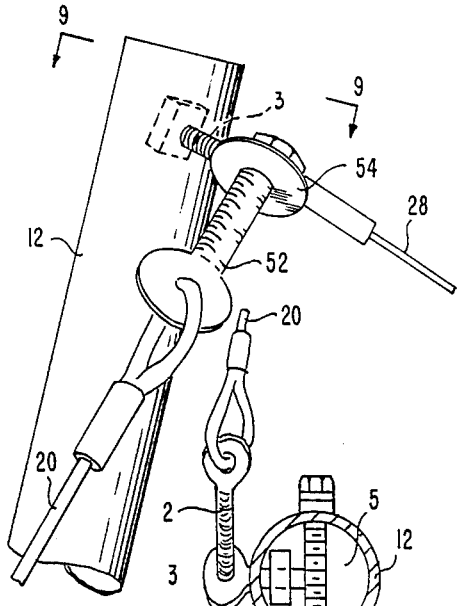
FIG. 8 is an enlarged perspective view of a leg, at a leg-table frame joint.

An adjustable thumb screw 3 is bolted transversely through a hole at the top of the outer leg tube, directed perpendicular to the joint bolt 5. Another adjustable thumb screw 2 is bolted through a hole in the flat end of thumb screw 3. A pair of leg brace cables 20 are looped through the hole in the flat end of thumb screw 2, as shown in FIGS. 8 and 9, and extended diagonally to the lower part of the opposite leg located at the same end, and looped thereon, for lateral support and stability, as shown in FIG. 7.

Figure 6:
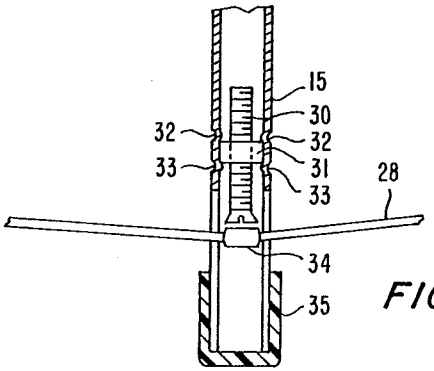
FIG. 6 is a side sectional view of the bridge tube.

A bridge cable 28 running longitudinally along the underside of the table, close to the inner frame in an V shape, frame one end of the table to the other end is looped around bolt 5 between the top end of the leg and the table frame for superior strength as compared to prior art, which had used other attachment arrangements. In the opened position, the center of the bridge cables pass through a slot in the end of a bridge tube 15 and is fixed in place by a tab means 34 which is attached to the cable. A screw 30 affixed internally by a nut 31 means and crimps 32 and 33, respectively, inside the bridge tube, can be adjusted to raise or lower the bridge cable and thereby lowering or raising the middle of the table, as shown in FIG. 6. The bridge cable can be removed from the bridge tube when it is desired to use the table flat on the floor with the legs in a collapsed position.

Figure 10:
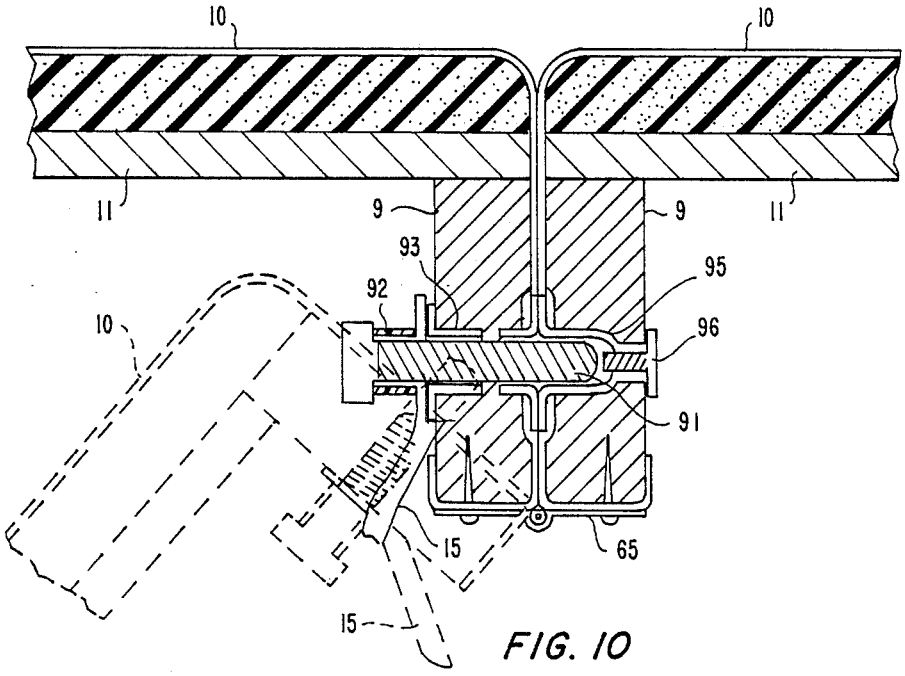
FIG. 10 is a side sectional view of the table frame locking mechanism.

As shown in FIG. 10, a table locking bolt 91 passes through a hole in the upper flattened end of the bridge tube. The bolt passes through a hole in one inner end of the table and through a corresponding hole in the inner end of the opposite section of the table. A nylon bushing 92 is placed between the head of the bolt and the bridge tube. The bolt passes through and internally threaded T-bolt 93 on the inner surface of the frame, and through and internally threaded T-nut 94 on the outer surface of the frame. When the table is in the fully opened position, the bolt passes through an internally threaded barrel T-nut 95 inserted in the outer edge of the outer table section. An end bolt 96 holds the barrel T-nut firmly in place. The bolt passing through both sections firmly locks the two table sections in place laterally and vertically and distributes the top load across both sections, eliminating the need for heavy elongated hinges which were needed for strength in prior art.

Figure 4:
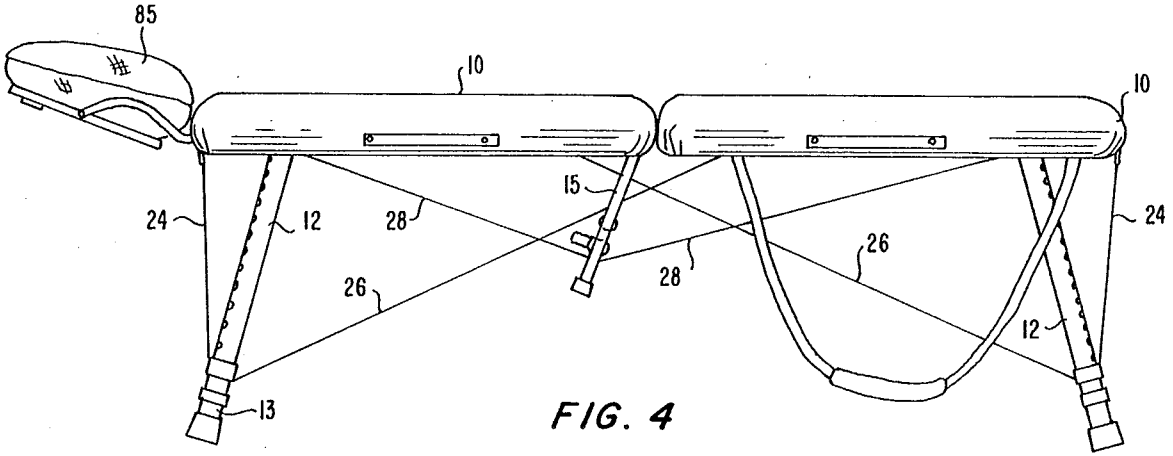
FIG. 4 is a side view of the table in a fully opened position, and the attached head rest.
Figure 5:
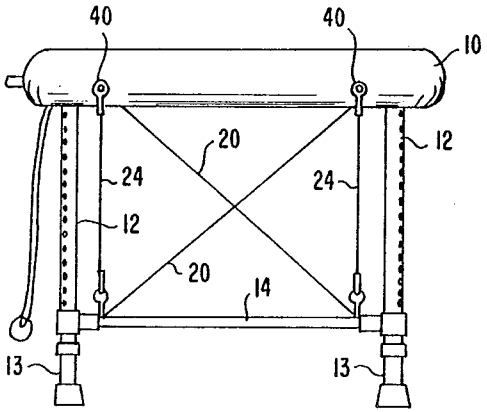
FIG. 5 is a end view of the table in a fully opened position.

In the opened position, the bridge, which is bent near the top end, extends angularly downward, as shown in FIG. 4. A bridge support cable 22 connected from the lower end of each bridge tube, extends across the width of the table and is secured at its center to the inner end of its section. This arrangement permits the bridge tubes to be placed close to the edges of the table, without a corresponding increase in structure weight, and thereby reducing the torque on the top of the table when a person is sitting on the edge. This arrangement allows the bridge cable to be attached to the leg joint bolt, which is directly attached to the side frame and thereby places a compression load on the side frame instead of a tension on the end frame, which would weaken the table and reduce its load carrying capacity. The angular arrangement allows the bridge tube to swing out of the way when the table is in the closed position, as shown in FIG. 2 or in the flat open position. A VELCRO piece 97 is attached to the lower end of the bridge tube which attaches to VELCRO on a block 98 attached to the undersurface of the table, when the table is in the closed or semi-closed position, as shown in FIG. 2.

A table-leg brace cable 26 is looped around each outer end of each horizontal brace tube 14, and extends lengthwise and diagonally to the side of the opposite section a short distance from the inner end of that section, as shown in FIG. 3. This arrangement keeps the leg pair from outwardly collapsing, permits the detachment of the end cables 24 when the table is partially closed, as shown in FIG. 2, and places a strong tension on the end cables, when attached, resulting in a extremely stable configuration in the opened position.

A pair of end cables 24 are adjustably attached to the horizontal brace tube and detachably connected, by means of grommets 45 onto a snap 44, to the outer end of each section. When in a fully opened and connected position, this arrangement keeps the leg pair from inwardly collapsing and requiring a rigid weight adding leg brace.

Figure 11:
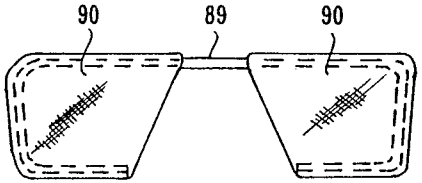
FIG. 11 is a top view of an arm rest.
Figure 12:
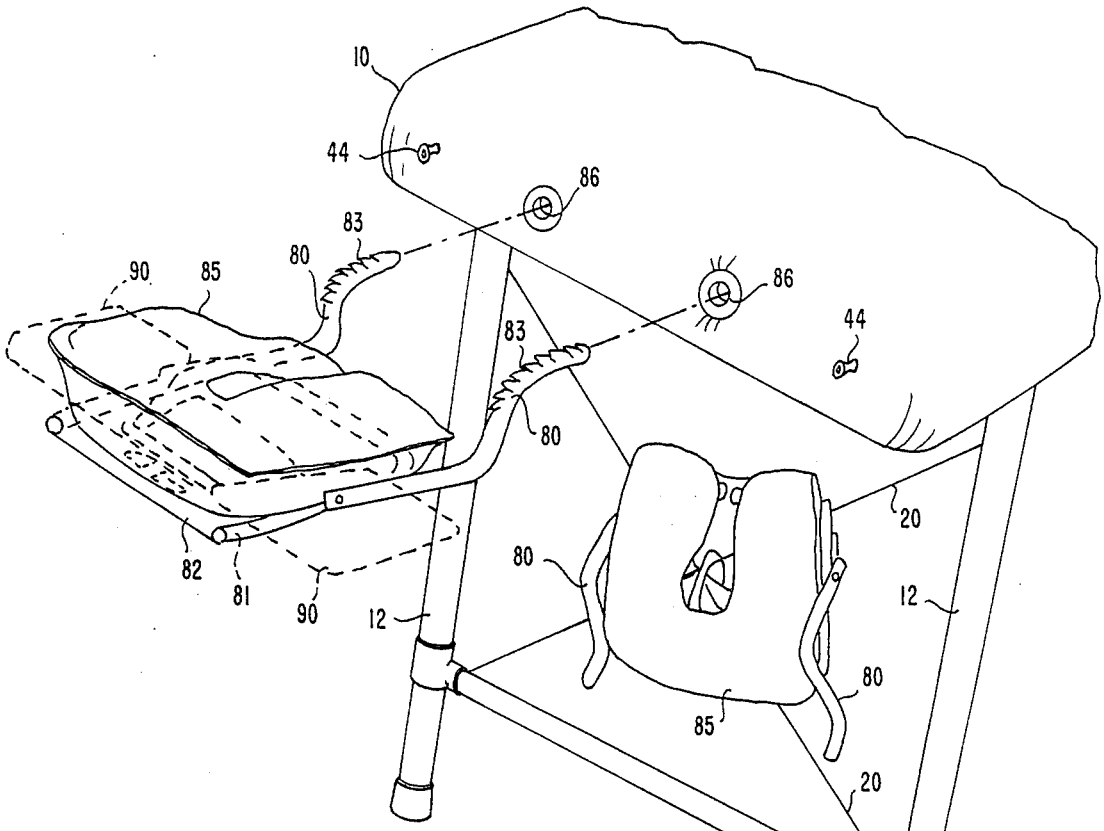
FIG. 12 is a partial perspective view of the head rest, in a detached and in a stored position.
Figure 13:
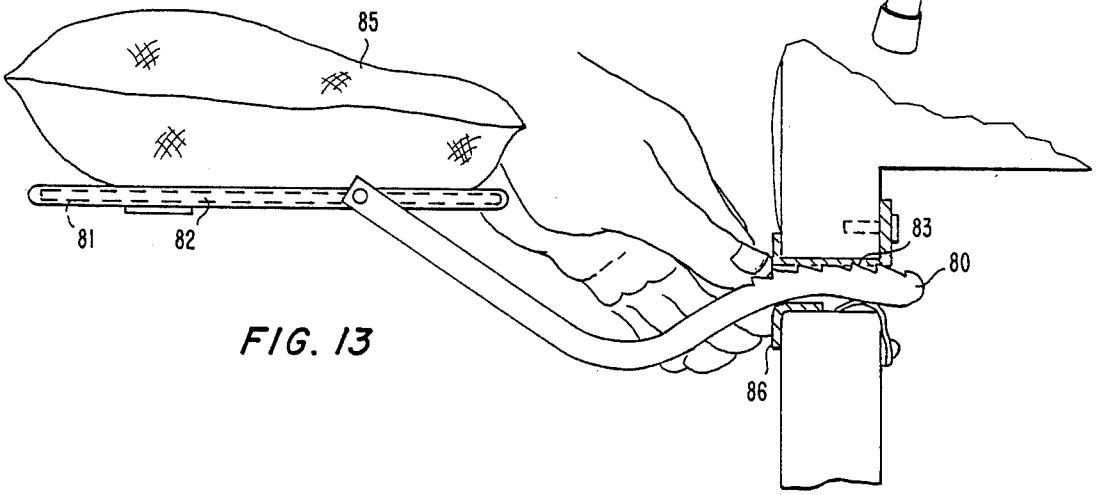
FIG. 13 is a side section of the head rest inserted in the end of the table.

A soft face rest 85 is supported by a cloth surface 82, the outer perimeter of which is inserted a U-shaped tube 81. The cloth reduces the weight of the headrest. Both sides of the U-shaped tube is rotatably attached to an S-shaped head support tube 80. The other end of the head support tube is upwardly notched 33. The notched end of the tubes are inserted into grommets 86 which are located at the end of the table. A spring 98 and tab 99 means holds the head support tube in place. This permits the headrest to be readily raised or lowered. A removable handrest, as shown in FIG. 11, consisting of a C-shaped tube 89 covered by cloth 90 at each end, can be inserted between the face rest and the surface as seen in FIG. 12, which shows the handrest 90 inserted between the cloth surface 82 and the U-shaped tube 81 of the face rest. The flat surface inserted therein maintains the handrest in a horizontal plane. A convenient platform for the person being massaged is thereby provided so they may rest their arms or hands alongside their head.

Carrying handles 61 are affixed to one corresponding side of each section. A shoudler strap 60 is detachably affixed to one inner edges of the frame.

I claim:

1. A light-weight folding massage table, comprising:

a pair of hingedly connected rectangular sections, having a padded upper surface and a peripheral underframe, said sections in an optionally opened position, with the sections being coplanar, or in a closed position, with the sections being parallel;

two pairs of telescoping legs rotatably connected to the side of the underframe near each end, which when the table is either in the closed position or in the flat opened position is coplanar to the undersurface of the table, and when the table is in the raised opened position extend angularly outward and downward from the underside of the table, providing substantial longitudinal stability;

a horizontal brace tube affixed to each leg of each leg pair;

two pair of leg brace cables overlappingly attached, in an X-configuration, from the lower end of one leg to the upper end of the other leg of the leg pair by an adjustment means, providing the leg pairs with a high degree of stability;

a pair of table locking bolts which pass through holes in the inner ends of the undersurface of both sections of the table, locking both sections together, when the table is in a fully open position and is held in place by a locking means;

a pair of bridge tubes rotatably connected to the locking bolts at the upper end and slit lengthwise at their lower end, which when the table is in the closed position or in the opened flat position is attached to the undersurface of the table and when the table is in the raised opened position extends angularly downward from the undersurface of the table, wedging the bridge tube againt the frame;

a pair of bridge cables running longitudinally in a V-shaped manner along the inner edge of the underframe, connected at each end to the upper leg joints and passing through the slit in the bridge tube, providing for compression of the table sections;

a bridge support cable is connected from the lower end of each bridge tube, and is secured at its center to the table end frame in an inverted V-shape;

a pair of end cables at each end of the table, attached to the horizontal leg brace by an adjustable means and detachably connected at the other end of the end cable to the end of the table providing longitudinal stability independent of the bridge cables;

two pairs of table-leg brace cables on each side of the table, each being attached at one end to the near end to the lower part of a leg, and attached at the other end to the near end of the opposite section, providing a tension on the end cable and longitudinally stabilizing the leg pairs;

a head rest detachably affixed to the outer end of one section;

a horizontal hand rest removably affixed to the head rest;

carrying handles affixed to one of the outer edges of each section;

a carrying strap is detachably affixed to the edge of the table.

2. The light-weight folding massage table as defined in claim 1 with a head rest comprising:

a pair of S-shaped support tubes upwardly notched at one end, said the notched end being inserted into the end of one table section, and held in place by a spring and tab means permitting the headrest to be optionally raised or lowered;

a U-shaped tube rotatably attached to the unnotched end of each support tube;

a support cloth stretchably affixed across the U-shaped tube;

a soft face rest supported by and affixed to the support cloth.

3. The light-weight folding massage table as defined in claim 1 wherein an adjustment bolt is longitudinally and affixed internally within the bridge tube, such that by recessing and extracting the bolt the middle of the table is lowered and raised, respectively.

* * * * *